US012012656B2

(12) United States Patent
Kweon

(10) Patent No.: US 12,012,656 B2
(45) Date of Patent: Jun. 18, 2024

(54) APPARATUS FOR COOLING HOT-DIP PLATED STEEL SHEET

(71) Applicant: POSCO, Pohang-si (KR)

(72) Inventor: Yong-Hun Kweon, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 309 days.

(21) Appl. No.: 17/284,152

(22) PCT Filed: Oct. 14, 2019

(86) PCT No.: PCT/KR2019/013423

§ 371 (c)(1),
(2) Date: Apr. 9, 2021

(87) PCT Pub. No.: WO2020/080766

PCT Pub. Date: Apr. 23, 2020

(65) Prior Publication Data

US 2021/0332468 A1 Oct. 28, 2021

(30) Foreign Application Priority Data

Oct. 19, 2018 (KR) ..... 10-2018-0125178

(51) Int. Cl.
*C23C 2/00* (2006.01)
*C23C 2/20* (2006.01)
*C23C 2/26* (2006.01)

(52) U.S. Cl.
CPC ..... *C23C 2/20* (2013.01); *C23C 2/00344* (2022.08); *C23C 2/004* (2022.08); *C23C 2/26* (2013.01); *C23C 2/261* (2022.08)

(58) Field of Classification Search
None
See application file for complete search history.

(56) References Cited

U.S. PATENT DOCUMENTS

2009/0114149 A1* 5/2009 Lee ..... C23C 2/20 118/62
2011/0177253 A1 7/2011 Oohashi et al.
(Continued)

FOREIGN PATENT DOCUMENTS

JP H07026358 1/1995
JP H08337864 12/1996
(Continued)

OTHER PUBLICATIONS

English translation of KR20130060903.*
(Continued)

*Primary Examiner* — Charles Capozzi
(74) *Attorney, Agent, or Firm* — CANTOR COLBURN LLP

(57) ABSTRACT

Provided is an apparatus for cooling a hot-dip plated steel sheet, the apparatus being capable of reducing comb-pattern surface defects occurring on the edge portion of the hot-dip plated steel sheet. The apparatus includes: a gas knife for spraying wiping gas to a steel sheet that has passed through a plating bath, thereby adjusting the plating thickness thereof; a defect prevention portion installed downstream of the gas knife so as to spray cooling gas to the steel sheet, thereby cooling same; and a moving portion for driving the defect prevention portion such that same moves.

12 Claims, 6 Drawing Sheets

(56) References Cited

U.S. PATENT DOCUMENTS

| | | | | |
|---|---|---|---|---|
| 2012/0107636 | A1 | 5/2012 | Diez et al. | |
| 2017/0002451 | A1 | 1/2017 | Kim et al. | |
| 2018/0171461 | A1* | 6/2018 | Jee | B05C 3/125 |
| 2020/0248295 | A1 | 8/2020 | Diez et al. | |
| 2021/0291222 | A1* | 9/2021 | Nishi | B05D 3/06 |

FOREIGN PATENT DOCUMENTS

| | | | | |
|---|---|---|---|---|
| JP | H11140615 | | 5/1999 | |
| JP | 2004059944 | | 2/2004 | |
| JP | 4988045 | | 8/2012 | |
| JP | 2012526915 | | 11/2012 | |
| KR | 20130074269 | | 7/2013 | |
| KR | 101359079 | | 2/2014 | |
| KR | 101419585 | | 7/2014 | |
| KR | 101461746 | | 11/2014 | |
| KR | 20150073306 | | 7/2015 | |
| KR | 20150073308 | | 7/2015 | |
| KR | 20150089324 | | 8/2015 | |
| KR | 101858854 | | 5/2018 | |
| WO | WO-2016195437 | A1 * | 12/2016 | B05C 3/125 |

OTHER PUBLICATIONS

English translation of KR101858854.*

International Search Report—PCT/KR2019/013423 dated Jan. 23, 2020.

Japanese Office Action—Japanese Application No. 2021-520358 dated Apr. 5, 2022, citing KR 10-1858854, JP 2017-503927, KR 10-1359079, JP H08-337864, JP 2004-059944, KR 10-2013-0074269, KR 10-2015-0073306. and KR 10-1461746.

* cited by examiner (a)

(b)

APPARATUS FOR COOLING HOT-DIP PLATED STEEL SHEET

TECHNICAL FIELD

The present disclosure relates to, for example, an apparatus for cooling a hot-dip plated steel sheet which, when a highly-corrosion resistant plated steel sheet is manufactured in a continuous hot-dip galvanizing process, may reduce a comb-patterned surface defect occurring on an edge of a hot-dip plated steel sheet.

BACKGROUND ART

Generally, a hot-dip plated steel sheet refers to a plated steel sheet which may be manufactured by allowing the steel sheet to pass through a plating bath in a molten state in which one or two or more of zinc (Zn), aluminum (Al), lead (Pb), or the like, are mixed, or magnesium (Mg), titanium (Ti), nickel (Ni), or the like, is added to the mixture in an appropriate concentration.

When a hot-dip plated steel sheet is manufactured, as a molten metal attached to a surface of the steel sheet may react with oxygen in the air when the molten metal solidifies, an oxide film may be formed on a surface of a plated layer. The oxide film may cause non-uniformity in a solidification rate and solidification properties of the molten metal such that various defects may occur in the plated layer, and in particular, the oxide film may cause surface defects such as flow patterns, whisker patterns, and rain marks, such that uniformity, smoothness and glossiness of a product may degrade.

In particular, in a zinc-based plating bath to which a strong oxidizing material such as magnesium, titanium, and aluminum are added, the degree of formation of an oxide film may increase. Accordingly, when the surface is painted to improve corrosion resistance and to make the steel sheet aesthetically appealing, it has been difficult to secure a painted surface which is aesthetically appealing while having excellent image quality.

To solve the disadvantage, when the plating amount of the steel sheet lifted from the plating bath is controlled, a technique of manufacturing a hot-dip plated steel sheet with improved surface quality by reducing the oxidation reaction of zinc by using a method of performing wiping using nitrogen gas, instead of general air wiping using air, while being exposed in the air, has been used.

For example, in Korean Registered Patent Publication No. 1419585, by installing a sealing box on the plating bath and introducing nitrogen through a wiping nozzle in the sealing box, the atmosphere in the sealing box may be maintained in a non-oxidizing atmosphere such that an oxide film may be prevented from being formed on the surface of the plated layer.

Meanwhile, when the plating amount of the highly-corrosion resistant plated steel sheet is high, oxidative surface defects, and also a comb-patterned surface defect may additionally occur on an edge of the hot-dip plated steel sheet. As the comb-patterned surface defect on the edge has a different formation mechanism from that of the oxidative surface defect, a separate reduction means other than the sealing box has been necessary.

DISCLOSURE

Technical Problem

The purpose of the present disclosure is to, by providing an apparatus which may reduce a comb-patterned surface defect occurring on an edge of a hot-dip plated steel sheet, implement high quality and to contribute to improvement of productivity of a highly-corrosion resistant plated steel, for example.

Technical Solution

A cooling apparatus according to one embodiment of the present disclosure is characterized by including a gas knife for adjusting a plating thickness by spraying a wiping gas onto a steel sheet passing through a plating bath; a defect prevention portion installed downstream of the gas knife and cooling the steel sheet by spraying a cooling gas onto the steel sheet; and a moving portion driven to move the defect prevention portion.

Advantageous Effects

According to one aspect of the present disclosure as above, a uniform solidification layer may be formed in a width direction of the steel sheet through cooling of a center of the steel sheet, and accordingly, when the steel sheet moves vertically, the uniform solidification layer on the plated surface layer portion may weaken surface tension formed in the width direction of the steel sheet, and may also reduce the comb-patterned surface defect consequently, thereby obtaining an effect of improving surface quality and productivity of the hot-dip plated steel sheet.

BEST MODE FOR INVENTION

Figure 1:
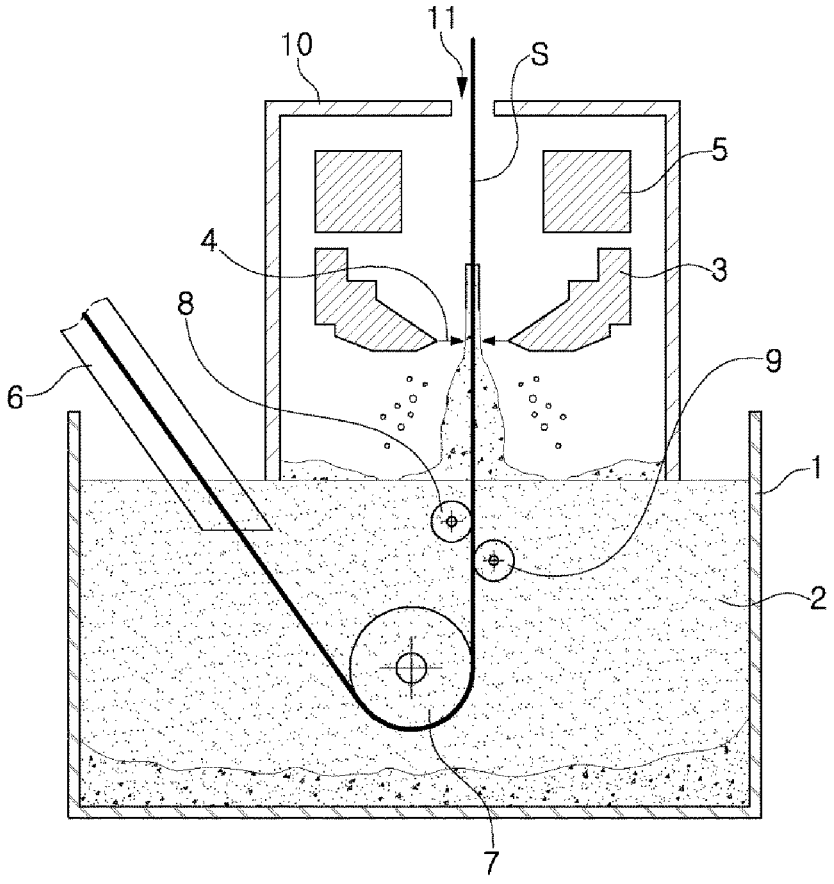
FIG. 1 is a diagram illustrating a hot-dip plating apparatus to which a cooling apparatus is applied according to an embodiment of the present disclosure.

In the description below, the present invention will be described in detail. In adding reference numerals to elements in each drawing, it should be noted that the same elements may have the same numerals as possible even if they are indicated on different drawings. Also, in describing the present disclosure, when it is determined that a detailed description of a related known configuration or function may obscure the subject matter of the present invention, a detailed description thereof will be omitted.

FIG. 1 is a diagram illustrating a hot-dip plating apparatus to which a cooling apparatus is applied according to an embodiment of the present disclosure.

The hot-dip plating apparatus may include a plating bath 1 in which a molten metal 2 is accommodated; a gas knife 3 for controlling a plating thickness by spraying a wiping gas 4 to the steel sheet S drawn upwardly from the plating bath; and a frame 5 configured to be spaced apart from the gas knife and to surround an upper region to which the steel sheet is transferred.

Alternatively, the hot-dip plating apparatus may further include a sealing box 10 surrounding the gas knife 3 and the frame 5 and isolating the bath surface of the plating bath 1 from the surrounding atmosphere.

For example, in a continuous hot-dip galvanizing process, an annealing treatment may be performed on the steel sheet S in a heat treatment furnace (not illustrated), the steel sheet S may enter the plating bath 1 filled with the molten metal 2 through a snout 6, a direction of the steel sheet S may change through a sink roll 7 disposed in the plating bath, and the steel sheet S may move upwardly.

A stabilizer roll 8 and a collector roll 9 may be provided in an upper portion of the sink roll 7, and the rolls may prevent bending and vibration of the steel sheet by tension by pushing front and back surfaces of the steel sheet S.

When the steel sheet S is immersed in the plating bath 1 and is discharged from the plating bath 1, the molten metal 2 may be attached to the surface of the steel sheet S, and the plating thickness of the molten metal may be adjusted by the wiping gas 4 sprayed by the gas knife 3 installed on the upper portion of the plating bath.

The gas knife 3 may be provided in a pair, and may adjust the plating amount of one side surface and the other side surface of the steel sheet S.

The gas knife 3 may be connected to the frame 5 by a gas supply pipe (not illustrated), and the frame may surround an upper region of the gas knife to which the steel sheet S is transferred.

The wiping gas 4 may be supplied to the gas knife 3 through the frame 5 and a gas supply pipe. As the wiping gas, an inert gas such as nitrogen or argon may be used.

As described above, the sealing box 10 may surround the gas knife 3 and the frame 5 and may isolate the bath surface of the plating bath 1 from the surrounding atmosphere. The sealing box may shield the periphery of the steel sheet S passing through the plating bath 1 other than an exit 11 formed in a minimal area to allow the steel sheet S to pass through vertically. Also, a region between the sealing box and the bath surface of the plating bath may be sealed by a sealing member (not illustrated).

By injecting an inert gas such as nitrogen or argon into the sealed space formed by the sealing box 10, a concentration of residual oxygen may be reduced such that an inert atmosphere, a non-oxidizing atmosphere, may be formed. Also, to maintain the non-oxidizing atmosphere in the sealed space in the sealing box, the gas knife 3 may continuously spray an inert gas such as nitrogen or argon as the wiping gas 4.

The exit 11 of the sealing box 10 may be configured to have an opening area larger than a cross-sectional area of the steel sheet so as not to be in contact with the steel sheet to prevent scratches on the plated layer of the steel sheet when the steel sheet S vertically passes through.

Figure 2:
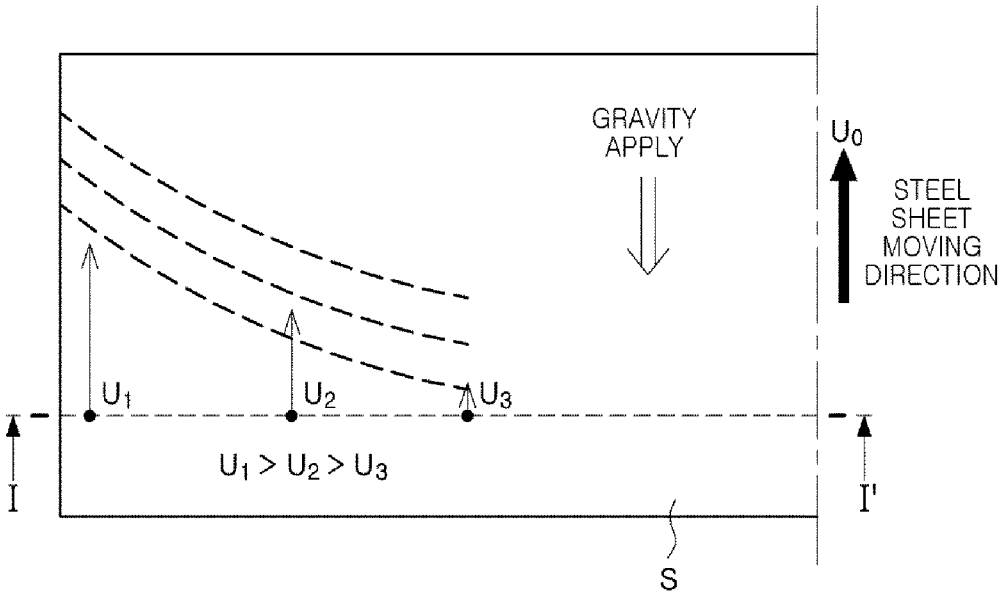
FIG. 2 is diagrams illustrating a formation mechanism of a comb-patterned surface defect occurring on an edge of a hot-dip plated steel sheet.
Figure 2:
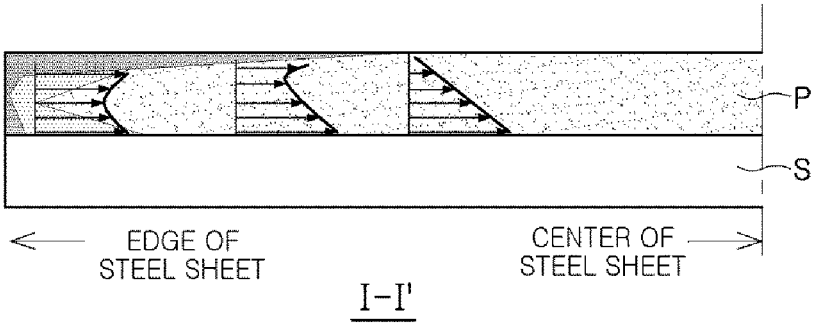

FIGS. 2(*a*) and 2(*b*) are diagrams illustrating a mechanism of formation of comb-patterned surface defect occurring on an edge of a hot-dip plated steel sheet.

Generally, when the steel sheet S moves vertically after being immersed in the plating bath 1, an edge of the steel sheet may be cooled faster than a center of the steel sheet due to a latent heat of the steel sheet. Accordingly, non-uniform solidification may occur on a surface layer portion of the plated layer in the width direction of the steel sheet due to a different in temperatures between the edge and the center.

As illustrated in FIG. 2(*b*), the plated layer P may be rapidly solidified at the edge of the steel sheet as compared to the center of the steel sheet, and the solidification may be gradually performed toward the center.

As for a speed distribution in the plated layer P, a speed of the plated layer adjacent to the surface of the steel sheet S in the plated layer may be the same as a moving speed ($U_0$) of the steel sheet, and the speed may approach to 0 toward surface layer portion of the plated layer, which is in a non-solidified state. However, since the surface layer portion of the plated layer is in a solidified state at the edge of the steel sheet, the speed of the surface layer portion of the plated layer at the edge may have a non-zero value. The plated layer may be more in a non-solidified state toward the center of the steel sheet.

Therefore, the plated surface layer portion may have a different speed depending on the position in the width direction of the steel sheet S, and the edge of the surface layer portion of the plated layer may have a speed higher than that of the center ($U_1>U_2>U_3$).

Also, since gravity is acting in the opposite direction in which the steel sheet S moves, the plated layer P, which is still in a non-solidified state, may be sufficiently affected by gravity.

Consequently, due to the speed difference occurring on the surface layer portion of the plated layer and the effect of gravity, surface tension may be formed in the width direction from the edge of the steel sheet S toward the center, and accordingly, a comb-patterned surface defect may be formed in a diagonal direction.

For example, when the amount of plating on a single side surface of the steel sheet is 250 g/m$^2$ or more, a comb-patterned surface defect may occur in the diagonal direction at the edge of the steel sheet, and the comb-patterns may have a length of about 300 mm in severe cases.

The comb-patterned surface defect may have a different formation mechanism from that of an oxidative surface defect, and may thus not be addressed only with the sealing box 10 described above. In particular, to ensure high quality when a highly-corrosion resistant plated steel sheet is manufactured, it may be important to reduce the oxidative surface defect, and also the comb-patterned surface defect at the edge occurring in the thick plated layer P.

Figure 3:
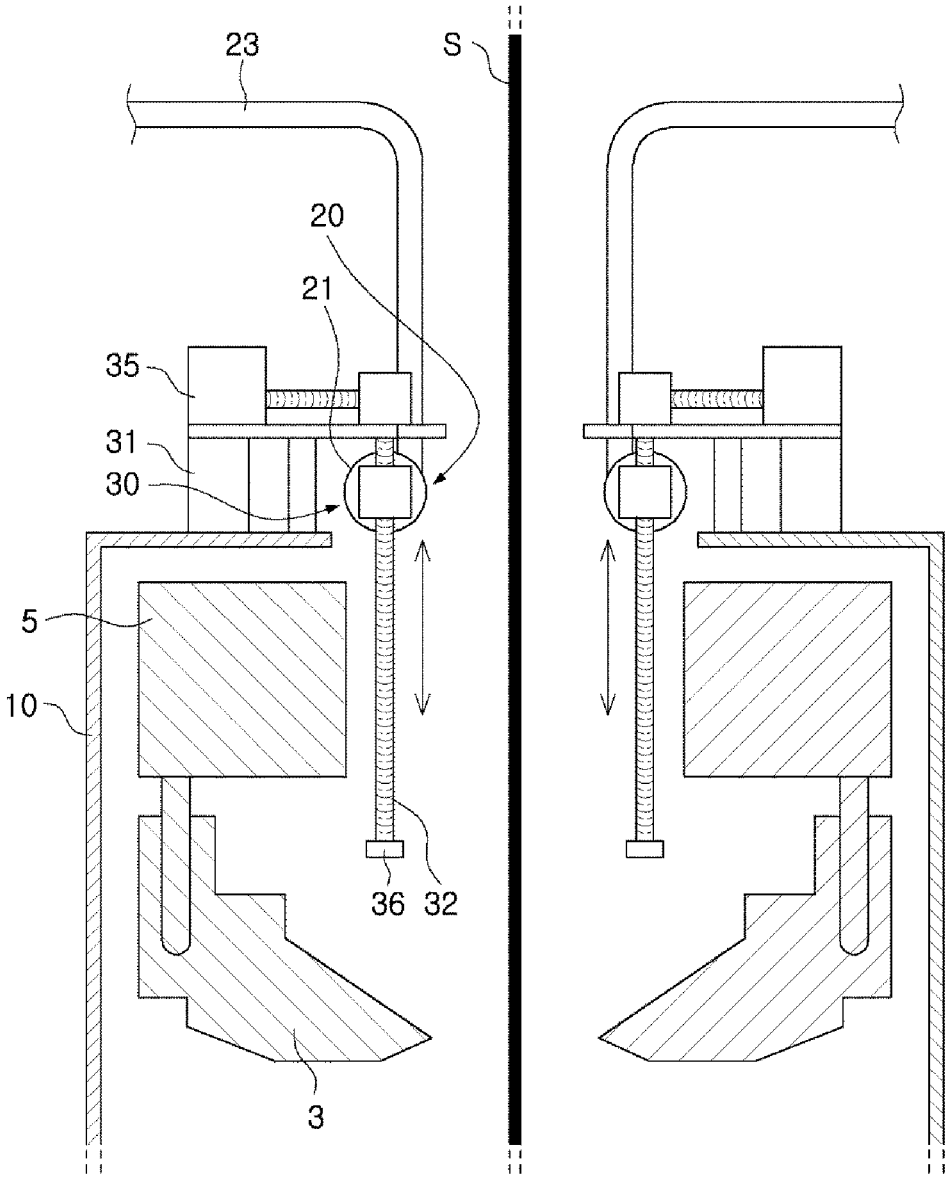
FIG. 3 is a lateral diagram illustrating a cooling apparatus according to an embodiment of the present disclosure.
Figure 4:
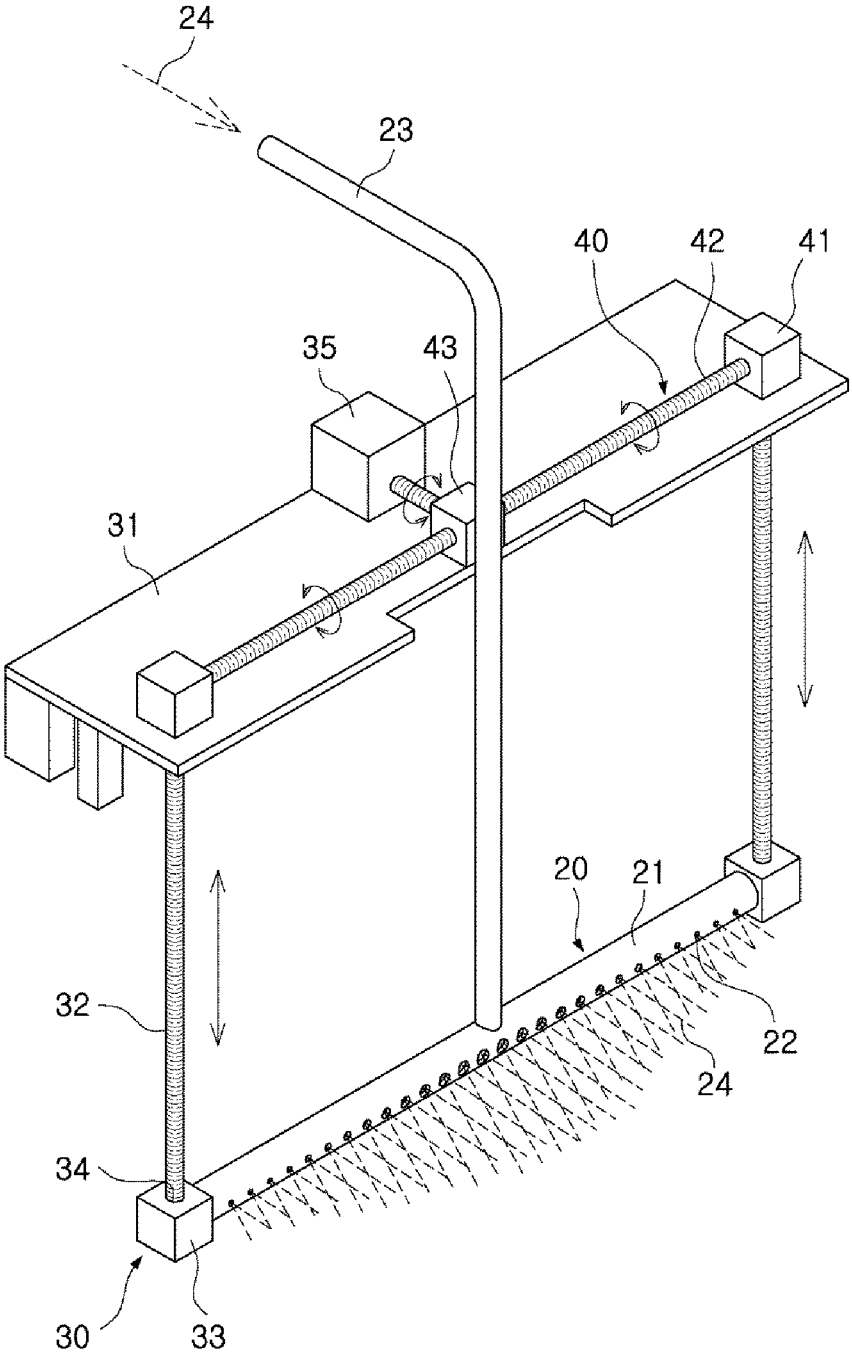
FIG. 4 is a perspective diagram illustrating an operating state of a cooling apparatus according to an embodiment of the present disclosure.

FIG. 3 is a lateral diagram illustrating a cooling apparatus according to an embodiment of the present disclosure. FIG. 4 is a perspective diagram illustrating an operating state of a cooling apparatus according to an embodiment of the present disclosure.

As illustrated in the drawings, the cooling apparatus according to an embodiment of the present invention may include the gas knife 3 for controlling the plating thickness by spraying the wiping gas 4 (see FIG. 1) on the steel sheet S having passed through the plating bath 1 (see FIG. 1); a defect prevention portion 20 installed downstream of the gas knife and cooling the steel sheet by spraying a cooling gas 24 to the steel sheet; and a moving portion 30 driven to move the defect prevention portion.

The cooling apparatus according to an embodiment of the present invention may mainly perform cooling by spraying the cooling gas 24 to the center of the steel sheet S, such that uniform solidification may be formed on the plated layer P (see FIG. 2(*b*)) in the width direction of the steel sheet, and the formation of comb-patterned surface defect may be prevented on the edge of the steel sheet.

The steel sheet S of which the surface is plated by the molten metal 2 (see FIG. 1) in the plating bath 1 may be withdrawn from the plating bath, and the plating amount may be controlled by the gas knife 3.

The gas knife 3 may control the plating amount by spraying an inert gas such as nitrogen or argon to the steel sheet S to remove excessive molten metal 2 from the steel sheet.

The steel sheet S of which the plating amount has been controlled may pass through the defect prevention portion 20 forming a main part of the present invention following the gas knife 3, and the defect prevention portion may intensively spray the cooling gas 24 to the center of the steel sheet.

A pair of the defect prevention portion 20 may be disposed on both side surfaces of the moving steel sheet S, respectively. Also, each of the defect preventing portion may be disposed horizontally throughout at least the center of the steel sheet in the width direction.

The defect prevention portion 20 may include a main body 21 having a tubular shape and having at least one nozzle 22, and a supply pipe 23 connected to the main body and supplying the cooling gas 24 to the main body.

The length of the main body 21 (the length extending in a direction parallel to the width direction of the steel sheet S) may be shorter than a width of the steel sheet, and in consideration of the width of the steel sheet actually manufactured, the length may be in the range of about 1000-1600 mm, for example, but an embodiment thereof is not limited thereto.

The nozzle 22 provided in the main body 21 may be formed in a hole shape or a slit shape.

Figure 5:
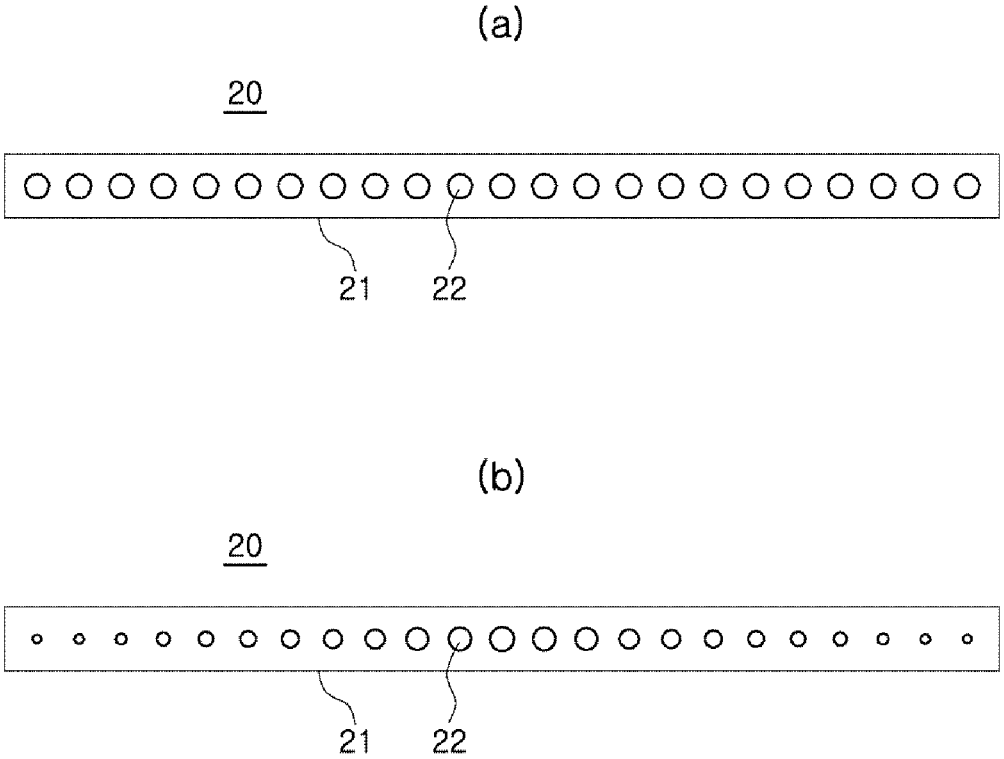
FIG. 5 is front views illustrating a defect prevention portion which may be used in a cooling apparatus according to an embodiment of the present disclosure.

FIGS. 5(*a*) and 5(*b*) are front views illustrating a defect prevention portion which may be used in a cooling apparatus according to an embodiment of the present disclosure. The main body 21 of the defect prevention portion 20 illustrated in FIGS. 5(*a*) and 5(*b*) may include a plurality of hole-type nozzles 22 arranged in a direction parallel to the width direction of the steel sheet S.

As illustrated in FIG. 5(*a*), the plurality of nozzles 22 may be formed as holes having the same diameter and may be arranged at least linearly.

Also, as illustrated in FIG. 5(*b*), among the plurality of nozzles 22, a nozzle disposed in a center of the main body 21 may have the largest diameter, and the diameter of the nozzles may decrease toward both ends of the main body. In this case, a larger flow amount of the cooling gas 24 sprayed toward the center of the steel sheet S as compared to the edges on both sides of the steel sheet S.

Figure 6:
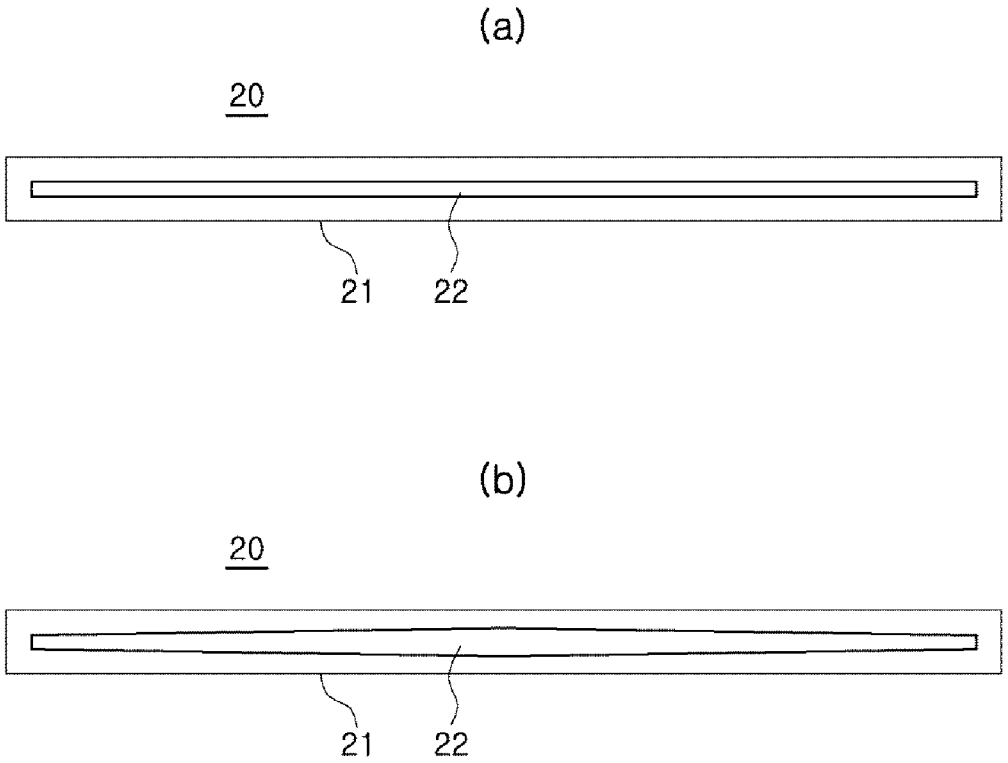
FIG. 6 is front views illustrating a modified example of a defect prevention portion which may be used in a cooling apparatus according to an embodiment of the present disclosure.

FIGS. 6(*a*) and 6(*b*) are front views illustrating a modified example of a defect prevention portion which may be used in a cooling apparatus according to an embodiment of the present disclosure. The main body 21 of the defect prevention portion 20 illustrated in FIGS. 6(*a*) and 6(*b*) may have a slit-type nozzle 22 extending in a direction parallel to the width direction of the steel sheet S.

As illustrated in FIG. 6(*a*), the nozzle 22 may have the same width throughout an entire length of the slit.

Alternatively, as illustrated in FIG. 6(*b*), the nozzle 22 may be configured to have the largest width in the center of the main body 21 and to have a width decreasing towards the both ends of the main body. In this case, a larger flow amount of the cooling gas 24 may be sprayed toward the center as compared to the edges on both sides of the steel sheet S.

One side of the main body 21 may be connected to a supply pipe 23 for supplying the cooling gas 24 formed of compressed air, or an inert gas such as nitrogen or argon, and the supplied cooling gas may be sprayed through the nozzle 22 of the main body, and mainly the center of the steel sheet S in the width direction may be cooled.

As described later, since the position of the defect prevention portion 20 is varied, to correspond to the varied positions, a corrugated pipe, or a flexible tube formed of a material such as fiber, rubber, and resin may be used as the supply pipe 23.

Referring to FIGS. 3 and 4, as the defect prevention portion 20 is connected to the moving portion 30, the position thereof may change, and the defect prevention portion 20 may respond according to the position in which the comb-patterned surface defect of the edge occurs. Here, the position of the comb-patterned surface defect may change according to the moving speed $U_0$ of the steel sheet S, the width of the steel sheet, and the plating amount.

The moving portion 30 may be selectively implemented as a linear motion guide. The moving portion may include a support portion 31; a bolt shaft 32 extending from the support portion and rotating in a forward and reverse direction through a driving force of the driving portion 35 connected to one side; and a moving block 33 connected to the main body 21 of the defect prevention portion 20, and including a nut portion 34 screwed to the bolt shaft and reciprocating along the bolt shaft.

The support portion 31 may be installed on the upper surface of the sealing box 10. However, an embodiment thereof is not limited thereto, and for example, the support portion 31 may be installed on the frame 5 supporting the gas knife 3. The support portion may include a bearing (not illustrated) for supporting the bolt shaft 32.

The driving portion 35 may be configured as a driving motor able to perform forward and reverse rotation. Accordingly, when the bolt shaft 32 rotates by the rotational driving of the driving portion, the moving block 33 and the main body 21 of the defect preventing unit 20 may linearly reciprocate by the operation of the nut portion 34 screwed to the bolt shaft.

The moving block 33 may be fixedly connected to at least one end of the main body 21 of the defect prevention portion 20. The nut portion 34 may be integrated with the moving block in the form of a through hole, or may be manufactured separately and may be firmly attached to the moving block.

In FIG. 3, reference numeral 36 denotes a stopper for blocking the movement of the moving block 33.

Also, the moving portion 30 may further include at least one guide (not illustrated) installed to extend in parallel to the bolt shaft 32. In this case, a guide hole (not illustrated) may be formed in the moving block 33 provided on one of the both ends of the main body 21 of the defect prevention portion 20, and the guide hole may be inserted to the guide, such that the moving block 33 and the main body 21 may move smoothly.

As illustrated in greater detail in FIG. 4, when the two moving portions 30 connected to the main body 21 of the defect prevention portion 20 are disposed on each of both sides of the support portion 31, a power transmission unit 40 may be interposed between the moving portion 30 and the driving portion 35.

The power transmission unit 40 may include a side gear box 41, a connection shaft 42, and a central gear box 43 when a driving motor is employed as the driving portion 35.

Two side gearboxes 41 may be disposed, and may be installed on the support portion 31 together with the driving portion 35. The side gearbox may be connected to the moving portion 30, more specifically, the bolt shaft 32.

Also, the central gear box 43 may be connected to a rotating shaft of the driving portion 35.

Each of the two connection shafts 42 may have one end connected to the side gear box 41 and the other end connected to the central gear box 43. In the connection shaft, a first gear such as a bevel gear and a worm gear may be formed at both ends, for example, and accordingly, a second gear such as a bevel gear or a worm wheel may be formed on the end of the bolt shaft 32 of each moving portion 30 and the end of the rotating shaft of the driving portion 35.

Therefore, by a single driving portion 35, that is, a single driving motor, the two moving portions 30 connected to both sides of the main body 21 of the defect prevention portion may be interlocked with each other and may operate simultaneously.

Here, the configurations, the connection relationship and the operation relationship of the moving portion 30, the driving portion 35 and the power transmission unit 40 are not limited to the above-described example.

For example, as the moving portion 30 and the driving portion 35 providing a driving force to enable reciprocating movement of the main body 21 of the defect prevention portion 20 or the moving block 33 connected to the main body, an actuator such as a fluid pressure cylinder having an operation rod may be applied.

Also, a plurality of the driving portions 35 may be configured to be connected to a plurality of the moving portions 30, respectively, without a power transmission unit.

Also, when a single driving portion 35 drives the moving portion 30 connected to one side of the main body 21 of the defect prevention portion 20 without a power transmission unit, a guide may be disposed on the other side of the main body 21 to guide the moving block 33.

Hereinafter, the operation of the cooling apparatus according to an embodiment of the present invention will be briefly described.

The steel sheet S to which the molten metal 2 is attached by passing through the plating bath 1 may be wiped by the wiping gas 4 ejected through the gas knife 3 and the plating amount may be adjusted. When the sealing box 10 is installed, the ejected wiping gas may form an inert atmosphere in the sealing box, such that an oxide film may not be formed on the surface of the plated layer.

The defect prevention portion 20 may move by driving the driving portion 35 according to the moving speed $U_0$ of the steel sheet S passing through, a width of the steel sheet, and the plating amount, and the defect prevention portion may move up and down by the driving of the driving portion 35 and the moving portion 30, such that the position to which the cooling gas 24 is sprayed from the defect prevention portion may change.

The cooling apparatus of the present invention may swiftly cool the center of the steel sheet by mainly spraying the cooling gas 24 to the center of the steel sheet S. Accordingly, uniform solidification of the plated layer P may be induced in the width direction of the steel sheet, and eventually, the formation of the comb-patterned surface defect on the edge of the steel sheet may be prevented.

Accordingly, according to the cooling apparatus of the present invention, a uniform solidification layer may be formed in the width direction of the steel sheet by cooling of the center of the steel sheet, and accordingly, when the steel sheet moves vertically, the uniform solidification layer of the plated surface layer portion may weaken surface tension formed in the width direction of the steel sheet and may accordingly reduce the comb-patterned surface defect, such that an effect of improving surface quality and productivity of the hot-dip-plated steel sheet may be obtained.

While the example embodiments have been illustrated and described above, it will be apparent to those skilled in the art that modifications and variations could be made without departing from the scope of the present disclosure as defined by the appended claims.

INDUSTRIAL APPLICABILITY

As described above, the present invention may be useful when a highly-corrosion resistant plated steel sheet is manufactured in a continuous hot-dip galvanizing process, for example.

The invention claimed is:

1. A cooling apparatus, comprising:

a gas knife for adjusting a plating thickness by spraying a wiping gas onto a steel sheet passing through a plating bath;

a defect prevention portion installed downstream of the gas knife and cooling the steel sheet by spraying a cooling gas onto the steel sheet;

a moving portion connected to the defect prevention portion; and a driving portion configured to move the moving portion up and down with the defect prevention portion connected thereto, wherein the defect prevention portion includes:

a main body having a tubular shape and having a nozzle; and a supply pipe connected to the main body and supplying the cooling gas to the main body, and wherein a length of the main body is shorter than a width of the steel sheet such that the cooling gas is sprayed toward a center of the steel sheet in a larger flow amount of the cooling gas than that sprayed towards edges on both sides of the steel sheet, and wherein the driving portion is configured to move the moving portion and the defect prevention portion connected thereto according to a moving speed of the steel sheet, the width of the steel sheet and a plating amount so that the defect prevention portion sprays the cooling gas towards a position where a comb-patterned surface defect occurs at both edges of the steel sheet, the position varying with the moving speed of the steel sheet, the width of the steel sheet and the plating amount.

2. The cooling apparatus of claim 1, wherein the nozzle comprises: a plurality of hole-type nozzles and the plurality of hole-type nozzles are arranged in a direction parallel to a width direction of the steel sheet.

3. The cooling apparatus of claim 2, wherein, among the plurality of hole-type nozzles, a nozzle disposed in a center of the main body has a largest diameter, and a diameter of the hole-type nozzles decreases toward both ends of the main body.

4. The cooling apparatus of claim 1, wherein the nozzle comprises: a slit-type nozzle extending in a direction parallel to a width direction of the steel sheet.

5. The cooling apparatus of claim 4, wherein the slit-type nozzle has a largest width in a center of the main body, and a width of the slit-type nozzle decreases toward both ends of the main body.

6. The cooling apparatus of claim 1, wherein the moving portion includes:

a support portion;

a bolt shaft installed to extend from the support portion, one side of the bolt shaft being connected to the driving portion, and rotating in a forward and reverse direction through a driving force of the driving portion; and a moving block connected to the main body of the defect prevention portion, and provided with a nut portion screwed with the bolt shaft and reciprocating along the bolt shaft.

7. The cooling apparatus of claim 6, wherein the support portion is installed on a frame supporting the gas knife or on an upper surface of a sealing box surrounding the gas knife and the frame and isolating a bath surface of the plating bath from surrounding atmosphere.

8. The cooling apparatus of claim 6, wherein the moving portion further includes at least one guide extending parallel to the bolt shaft and guiding movement of the defect preventing portion.

9. The cooling apparatus of claim 6, wherein, when the moving portion connected to the main body of the defect prevention portion is disposed on the support portion, a power transmission unit is interposed between the moving portion and the driving portion.

10. The cooling apparatus of claim 9, wherein the power transmission unit includes:

a side gear box connected to the moving portion;

a central gear box connected to a rotating shaft of the driving portion; and a connecting shaft having one end connected to the side gear box and the other end connected to the central gear box.

11. The cooling apparatus of claim 10, wherein a first gear is formed on both ends of the connecting shaft, and wherein a second gear is formed on an end of the moving portion and an end of the rotating shaft of the driving portion.

12. A cooling apparatus, comprising:

a gas knife for adjusting a plating thickness by spraying a wiping gas onto a steel sheet passing through a plating bath; and at least one movable spray positioned downstream of the gas knife and cooling the steel sheet by spraying a cooling gas onto the steel sheet;

wherein the at least one movable spray includes a main body having one or more nozzles, and a supply pipe connected to the main body and supplying the cooling gas to the main body, and a length of the main body is shorter than a width of the steel sheet such that the cooling gas is sprayed toward a center of the steel sheet in a larger flow amount of the cooling gas than that sprayed towards edges on both sides of the steel sheet, and wherein the at least one movable spray is configured to move up and down according to a moving speed of the steel sheet, the width of the steel sheet and a plating amount so that the at least one movable spray sprays the cooling gas towards a position where a comb-patterned surface defect occurs at both edges of the steel sheet, the position varying with the moving speed of the steel sheet, the width of the steel sheet and the plating amount.

* * * * *